United States Patent [19]

Holfeld et al.

[11] 4,030,880

[45] June 21, 1977

[54] PROCESS FOR IMPROVING DYEABILITY

[75] Inventors: Winfried Thomas Holfeld, Wilmington; Alfred John Strohmaier, Seaford, both of Del.

[73] Assignee: E. I. Du Pont de Nemours and Company, Wilmington, Del.

[22] Filed: Oct. 9, 1975

[21] Appl. No.: 621,089

[52] U.S. Cl. ..... 8/15; 8/17; 264/78; 264/136; 264/210 F; 264/290 N

[51] Int. Cl.[2] ..... D06P 1/00

[58] Field of Search ..... 8/15, 17; 264/210 F, 264/136, 290 N, 78

[56] References Cited

UNITED STATES PATENTS

| | | | |
|---|---|---|---|
| 3,091,805 | 6/1963 | Dusenburg | 264/78 |
| 3,233,019 | 2/1966 | Adams | 264/290 |
| 3,538,151 | 11/1970 | Baumann et al. | 260/512 |
| 3,684,426 | 8/1972 | Bindler | 8/15 |
| 3,713,768 | 1/1973 | Wegmuller et al. | 8/15 |
| 3,850,658 | 11/1974 | Gomez et al. | 57/157 S |
| 3,940,544 | 2/1976 | Marshall et al. | 428/395 |

FOREIGN PATENTS OR APPLICATIONS

| | | | |
|---|---|---|---|
| 1,177,246 | 1/1970 | United Kingdom | 264/78 |
| 1,299,777 | 12/1972 | United Kingdom | 264/78 |
| 1,369,586 | 10/1974 | United Kingdom | 264/78 |

*Primary Examiner*—Jay H. Woo

[57] ABSTRACT

Synthetic polycarbonamide filaments having more uniform acid dyeability are prepared in a melt-spinning and drawing process by applying a dye leveling agent to the filaments in a spin finish prior to drawing. Dye uniformity is improved with washfast, rate-sensitive acid dyes. The filaments may be processed conventionally prior to dyeing. Effective agents include sodium dodecyldiphenylether disulfonate and sulfated butyl oleate.

5 Claims, No Drawings

PROCESS FOR IMPROVING DYEABILITY

BACKGROUND OF THE INVENTION

1. Field of the Invention

This invention concerns a process for preparing synthetic polycarbonamide filaments having more uniform acid dyeability and filaments so produced. More particularly, it concerns a process of applying a dye-leveling agent to the filaments during their manufacture.

2. Description of the Prior Art

Articles composed of synthetic polycarbonamide filaments, commonly referred to as nylon filaments, are susceptible to nonuniform dyeing, particularly with acid dyes, which can be due to small differences in filament composition, physical structure, denier and other variables. Such differences can originate from inadequate control over filament spinning conditions such as polymer heat history, quenching rate, drawing, finish application and so forth. Such dyeing non-uniformities are particularly severe with washfast, acid dyes having large molecular structures. The large dye molecules do not readily transfer from one dye-site to another as do smaller acid dyes which give level dyeing but which have poorer dye washfastness.

It is known, for example, from U.S. Pat. Nos. 3,538,151, 3,658,460, 3,713,768 and Br. 1,299,777, that anionic dye-leveling agents can improve dyeing uniformity either as dyebath additives or in a bath pretreatment before dyeing. But at the concentrations frequently required to achieve acceptable leveling, such agents tend to increase the dye cycle times and can actually prevent satisfactory dyeing to deep colors and dark shades.

SUMMARY OF THE INVENTION

This invention provides in a melt-spinning and drawing process for the preparation of synthetic polycarbonamide filaments having more uniform acid dyeability, the improvement comprising applying to the filaments, prior to drawing, a finish containing from 0.05 to 0.5% by weight of the filaments of a dye-leveling agent selected from the group consisting of:

a. aromatic sulfonic acids and their condensation products;

b. sulfated derivatives of $C_{16}$ to $C_{22}$ unsaturated fatty acids and their alkyl esters; and c. alkali metal and ammonium salts of (a) and (b), and drawing the filaments contaning the finish to increase their molecular orientation.

Preferred aromatic sulfonic acids are p-($C_8$-$C_{18}$-alkyl)-diphenylether disulfonic acids; particularly the p-dodecyl derivative. Preferred sulfate derivative are sulfates of fatty esters of $C_1$-$C_8$ alcohols; particularly butyl oleate. The agents should contain at least 0.5, and preferably at least 1.0, milliequivalents per gram of the sulfonic or sulfate groups. The preferred salts in each instance are the sodium salts.

These agents are anionic dye-leveling agents for the washfast, large-molecule, rate-sensitive, acid dyes. Such dyes are represented, for example, by:

Anthraquinone Milling Blue BL (C.I. Acid Blue 122)
Carbolan Brill. Green 5GS — C.I. Acid Green 28
Telon Blue A3GL — C.I. Acid Blue 290
Telon F. Blue AFN — C.I. Acid Blue 264
Erionyl Brill. Red 10B — C.I. Acid Violet 54
Nylanthrene Blue GLF
Tectilon F. Blue RW Telon Violet BB — C.I. Acid Violet 103
Brill. Aliz. Mill. Violet FBL — C.I. Acid Violet 48
Nylosan Blue N5GL — C.I. Acid Blue 280
Nylosan Blue NFL — C.I. Acid Blue 278
Nylanthrene Orange SFL — C.I. Acid Orange 116
Du Pont Anth. Blue GSS — C.I. Acid Blue 230
Du Pont Mill. Red SWB — C.I. Acid Red 114

Another aspect of the invention is the synthetic polycarbonamide filaments having more uniform acid dyeability which are produced by the above process.

DESCRIPTION OF THE INVENTION

By this invention, it has been found that dye-leveling agents applied to synthetic polycarbonamide filaments in a primary spin finish prior to drawing provide filaments having more uniform acid dyeability in spite of interim treatments before dyeing such as heating, crimping and scouring. Applied in this manner, the agents show greater effectiveness at low concentrations as compared to quantities required as additives in conventional dye bath treatments; typically 1 to 2% of the leveling agent in the bath based on weight of the filaments. Because of the lower levels of agent employed in this invention there is less effect on dye cycle times and deep shades and bright colors can more readily be obtained. The large molecule, acid dyes can provide washfast fabrics without the need for chemical fixing after-treatments as normally employed to obtain adequate washfastness with the smaller molecule, level-dyeing acid dyes.

The leveling agent may be contained in the spin finish mixed with other conventional finish components, for example, as water-based suspensions and solutions, with appropriate compatible dispersing and lubricating agents. The finish preferably contains from about 10 to 30% by weight of the leveling agent based on the active finish components.

More preferred amounts of the leveling agents to be applied are from 0.1 to 0.3% by weight of the filaments.

The finish may be applied to undrawn or partially drawn filaments prior to drawing, or further drawing for the latter. These filaments are preferably drawn at a draw ratio of at least about 2. OX.

Following orientation drawing, the filaments may be processed in a conventional manner such as heating, for example, by heated rolls, and conventional texturing or crimping operations, for example, hot-fluid jet-bulking as described in U.S. Pat. No. 3,186,155 to Breen & Lauterbach. Filaments processed in this manner, either in continuous or separate operations still maintain the beneficial effects of the invention upon being dyed. Preferably aqueous finishes should have a pH slightly on the acidic side, for example, a pH of about 6.

This invention is effective in reducing dyeability differences produced, for example, by slight variations in both molecular orientation and heat history.

The invention is applicable to acid-dyeable synthetic linear polycarbonamide filaments, particularly aliphatic, linear, fiber-forming polycarbonamides. Such polymers are conventionally prepared by the condensation polymerization of aliphatic diamines and organic dicarboxylic acids, or their amide-forming derivatives, and also amino acids, as well as copolymers thereof; for example, poly(hexamethylene adipamide), poly(ε-caproamide), poly(hexamethylene dodecanediamide) and polymers or copolymers of bis(4-aminocyclohexyl)

methane with a 9–16 carbon linear aliphatic dicarboxylic acid.

The filaments can be formed conventionally by melt-spinning, quenching and drawing either by continuous or split (separate) processes.

The filaments can be dyed with conventional acid-dyeing procedures for the particular dyes to be used.

Yarn Dyeing Procedure

For dye testing in the following examples yarn samples are prepared by loosely winding 3.00 gram skeins. Thirty-six of these skeins, consisting of 6 control samples and 30 test samples, are scoured by immersing them in a vessel containing 21 l. of room temperature scouring solution comprised of 160 ml. ammonium hydroxide, 100 ml. 10% Merpol HCS, (a liquid, nonionic detergent from E. I. du Pont de Nemours and Co.), with the remainder of the solution being demineralized water. This bath has a pH of 10.4. The bath containing the yarn samples is heated to 95° C. at the rate of 3°/minute. The samples are removed and the bath discarded when the temperature reaches 95° C.

The yarns are then dyed by placing the 36 samples in 21 l. of an aqueous dye solution comprised of 200 ml. of a standard buffer solution at 3.8 pH, 100 ml. of 10% Merpol HCS (a liquid, nonionic detergent from E. I. de Pont de Nemours), 5 ml. Depuma (a silicone defoaming agent), and 500 ml. of 0.18% Anthraquinone Milling Blue BL [abbreviated MBB] (C.I. Acid Blue 122). The final bath pH is 4.4. The solution temperature is increased at 3°/min. from room temperature to 75° C., and held at that temperature for 30 minutes. The dyed samples are rinsed, dried, and measured for dye depth by a reflecting colorimeter.

The dye values are determined by computing K/S values from reflectance readings/ The equations are:

$$MBB \text{ dyeability} = \frac{K/S \text{ sample}}{K/S \text{ control}} \times 180 \text{ and } K/S = \frac{(1-R)^2}{2R}$$

when R = the reflectance value. The 180 value is used to adjust and normalize the control sample dyeability to a known base.

EXAMPLE I

Poly(hexamethylene adipamide) flake, prepared by a conventional autoclave process, is melted under vacuum processing conditions to increase the molecular weight and spun into 2450 denier, 128 filament yarn. The yarn has relative viscosity of about 70, measured at 25° C. on an 8.4% by weight solution in 90% formic acid, an amine-end level of 40, and a carboxyl-end level of 55, both expressed as equivalents per million grams of polymer.

Yarns are spun and drawn at 2.7 and 3.0 draw ratios [feed roll speeds 856 and 771 ypm respectively] using a draw roll speed of 2311 ypm. Finish application is by a standard rotating finish roll contacting the yarn prior to the draw zone. After the draw zone, the yarn is heated on two chest rolls operating at 215° C., then fed to a bulking jet using 240° C. air at 120 psig (844 kilograms per square centimeter). The yarn is wound up at 2077 ypm (1899 meters per minute) at a nominal 425 grams tension.

The finish compositions are comprised of 4% dye leveling agent (active ingredient basis), 16% of a nonionic, ethylene oxide-propylene oxide condensation product lubricant, and 80% water. A control yarn finish is similar except that the leveling agent is deleted. Finish level on yarn is ca./0.6–1.0% (non-aqueous components) giving a retarding agent level of 0.12–0.20% on weight of fiber. To increase dyeability differences, draw ratios of 2.7 and 3.0 are run. The draw ratio is changed by changing the speed of the hot chest rolls.

The yarn samples are dyed with Anthraquinone Milling Blue BL (C.I. Acid Blue 122), a typical rate-sensitive, large molecule, acid dye. Control yarns are also prepared using prior art finishes shown below.

Results of these experiments, shown in Table I, illustrate that the application of a leveling agent via the spin finish dramatically reduces dye variability caused by the differences in draw ratio.

Prior Art Finish No. 1

Primarily paraffinic hydrocarbons emulsified in water with sulfated oleyl triglycerides and soaps.

Prior Art Finish No. 2

Primarily coconut oil emulsified with sulfated oleyl triglycerides, non-ionic detergents, and soaps.

TABLE I

EFFECTIVENESS ON REDUCING DYEABILITY DIFFERENCES CAUSED BY DRAW RATIO

| | Leveling Agent** | | | | No Dye Leveling Agent | | |
|---|---|---|---|---|---|---|---|
| Dyeability | A* pH 6.0 | B pH 5.9 | C pH 6.0 | D pH 6.0 | Control pH 3.8 | Finish No. 1 pH 8.3 | Finish No. 2 pH 7.0 |
| 2.7 Draw Ratio | 192.7 | 173.4 | 181.0 | 192.3 | 201.6 | 207.8 | 195.1 |
| 3.0 Draw Ratio | 184.5 | 158.5 | 163.2 | 177.5 | 179.3 | 174.9 | 166.6 |
| Δ Dyeability/0.3 Draw Ratio | 8.2 | 14.9 | 17.9 | 14.7 | 22.3 | 32.9 | 28.5 |

*A — Alkanol ND - Du Pont trademark - sodium salt of dodecyldiphenyl oxide disulfonic acid, 1.53 meq./gm.
B — Univadine MC - Ciba/Geigy trademark - condensation products of aromatic sulfonic acids
C — Nylomine DN - ICI, America trademark - 80% sulfated butyl oleate, 20% ethoxylated tridecyl alcohol
D — Atexal LA-NS - ICI trademark - same as C (found to be most effective when applied at a finish pH of 5 to 8); 1.1 meq./gm. of sulfate.
**pH adjusted using citric acid

EXAMPLE II

In a manner similar to Example I, the effect of leveling agents applied in finish is tested on yarns having differing heat histories. These are prepared by running the hot rolls at 215° C., then at 195° C. The results shown below show a reduction in dye variability on yarns having differing thermal histories.

Table II

Effectiveness of Dye Levelers Reducing Dyeability Differences Caused by Thermal History

| Leveling Agent | Δ Dyeability*** | % Reduction* |
|---|---|---|
| D | 16.9 | 64 |
| B | 26.2 | 45 |
| E** | 15.0 | 68 |
| Control | 47.6 | — |

Table II-continued

| Effectiveness of Dye Levelers Reducing Dyeability Differences Caused by Thermal History | | |
|---|---|---|
| Leveling Agent | Δ Dyeability*** | % Reduction* |
| Prior Art Finish No. 1 | 34.7 | 27 |

*Vs. Control (same finish as Ex. I Control)
**Erional NW - Ciba/Geigy - mixed condensation product of naphthalene monosulfonic acids, dihydroxy diphenyl sulfonics and formaldehyde.
***Difference in MBB dyeability for 215° yarn minus 195° yarn.

What is claimed is:

1. In a melt-spinning and drawing process for the preparation of synthetic polycarbonamide filaments, the improvement for achieving more uniform acid dyeability comprising applying to the filaments, prior to drawing, a finish in an amount to provide from 0.05 to 0.5% by weight of the filaments of at least one dye-leveling agent containing at least 1.0 milliequivalents per gram of a sulfonic or sulfate group and selected from the group consisting of:

a. aromatic sulfonic acids and their condensation products;

b. sulfated derivatives of $C_{16}$ to $C_{22}$ unsaturated fatty acids and their alkyl esters; and c. alkali metal and ammonium salts of (a) and (b), and thereafter drawing the filaments containing the finish to increase their molecular orientation.

2. The process of claim 1 wherein the dye-leveling agent is a p-($C_8$ to $C_{18}$ alkyl)- diphenylether disulfonic acid, or the ammonium or alkali metal salt thereof.

3. The process of claim 2 wherein the alkyl group is dodecyl and the salt is sodium.

4. The process of claim 1 wherein the dye-leveling agent is a sulfated derivative of an unsaturated fatty ester of a $C_1$ to $C_8$ alcohol.

5. The process of claim 4 wherein the sulfated derivative is sulfated butyl oleate.

* * * * *